US005787673A

United States Patent [19]

Noble

[11] Patent Number: 5,787,673

[45] **Date of Patent: *Aug. 4, 1998**

[54] ANTENNA SUPPORT WITH MULTI-DIRECTION ADJUSTABILITY

[75] Inventor: Myron C. Noble, Plymouth, Ind.

[73] Assignee: PiRod, Inc., Plymouth, Ind.

[ * ] Notice: The term of this patent shall not extend beyond the expiration date of Pat. No. 5,333,436.

[21] Appl. No.: 255,342

[22] Filed: Jun. 7, 1994

Related U.S. Application Data

[63] Continuation-in-part of Ser. No. 944,258, Sep. 14, 1992, Pat. No. 5,333,436.

[51] Int. Cl.[6] ..... E04H 12/00; H01Q 1/12

[52] U.S. Cl. ..... 52/726.1; 52/726.3; 52/114; 52/40; 343/890; 343/892

[58] Field of Search ..... 52/726.1, 726.3, 52/726.4, 114, 40; 343/890, 891, 892

[56] References Cited

U.S. PATENT DOCUMENTS

| | | | |
|---|---|---|---|
| 7,412 | 6/1850 | Fisher . | |
| 578,524 | 3/1897 | Reid . | |
| 2,250,448 | 7/1941 | Edwards | 403/337 |
| 2,369,533 | 2/1945 | Cohen | 52/726.3 |
| 2,412,678 | 12/1946 | Goldman . | |
| 2,528,400 | 10/1950 | Trowbridge | 343/892 X |
| 2,641,703 | 6/1953 | Valach | 343/892 X |
| 2,743,441 | 4/1956 | Granquist | 343/890 X |
| 2,771,606 | 11/1956 | Kandoian | 343/890 |
| 3,345,826 | 10/1967 | Hignite . | |
| 3,373,434 | 3/1968 | Lorenzo et al. | 343/890 X |
| 3,421,781 | 1/1969 | Spurk . | |
| 3,544,110 | 12/1970 | Dickinson | 52/40 X |
| 4,086,012 | 4/1978 | Buckley et al. . | |
| 4,104,642 | 8/1978 | Padilla et al. | 343/892 X |
| 4,721,008 | 1/1988 | Stoops et al. . | |
| 4,745,412 | 5/1988 | Creaser, Jr. | 343/890 |
| 4,772,894 | 9/1988 | Foissac et al. | 343/890 X |
| 5,333,436 | 8/1994 | Noble | 52/726.3 |
| 5,467,955 | 11/1995 | Beyersmith | 343/890 X |
| 5,489,915 | 2/1996 | Bortiniker | 343/890 X |
| 5,533,304 | 7/1996 | Noble | 343/890 X |

*Primary Examiner*—Wynn Wood Coggins
*Attorney, Agent, or Firm*—Baker & Daniels

[57] ABSTRACT

An antenna support for mounting one or more antenna on a support structure such as a tower. The antenna support includes a framework mountable to the structure, and an antenna mounting support assembly coupled to the framework. The antenna mounting support assembly is configured to mount the antenna in a fashion to be adjustable in a multitude of directions relative to the support structure, such that the mounted antenna may be tuned by an installer by adjustments in these directions.

15 Claims, 7 Drawing Sheets

FIG.8
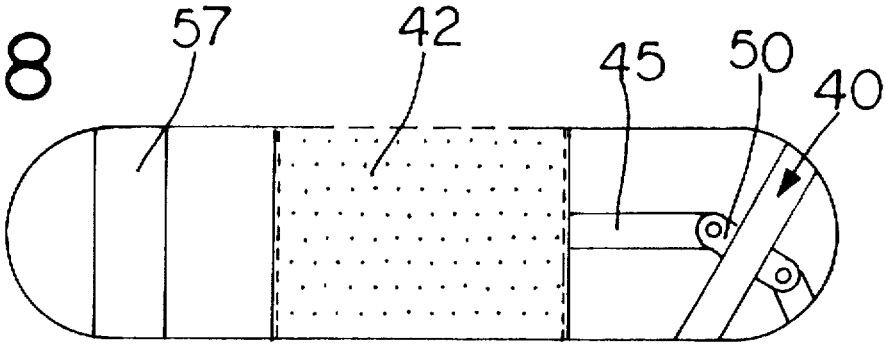
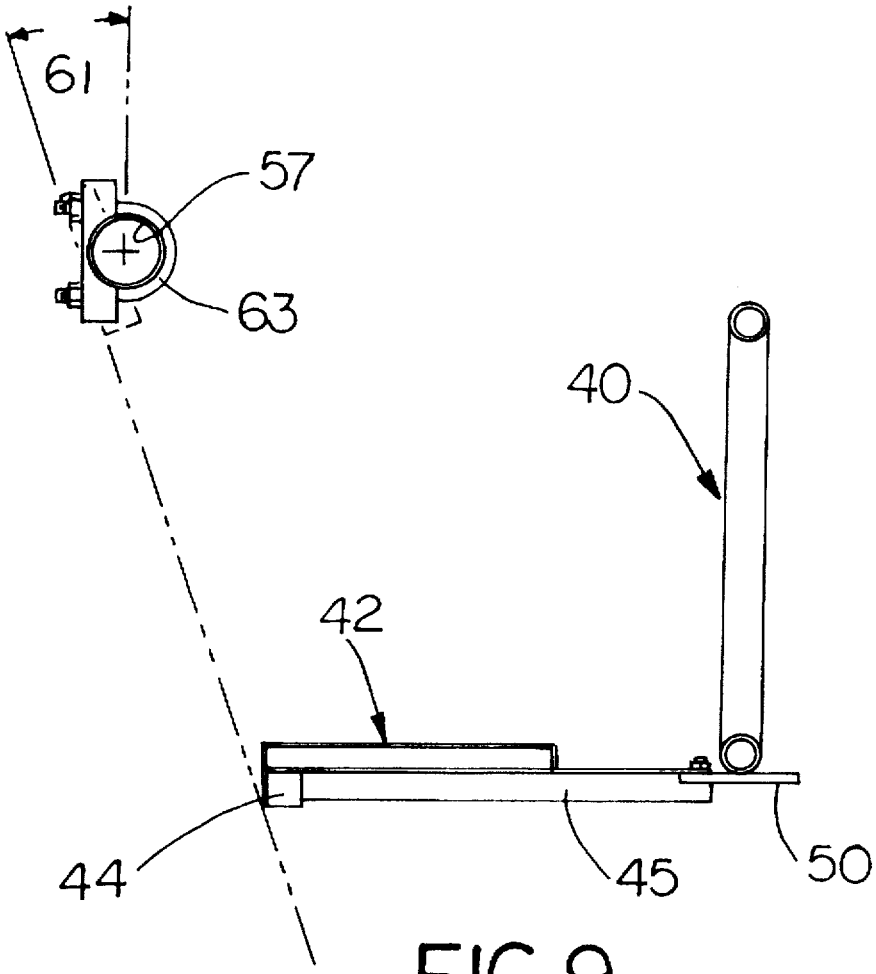
FIG.9

ANTENNA SUPPORT WITH MULTI-DIRECTION ADJUSTABILITY

This application is a continuation-in-part of U.S. application Ser. No. 07/944,258, filed Sep. 14, 1992, now U.S. Pat. No. 5,333,436.

BACKGROUND OF THE INVENTION

This invention relates to antenna supports, and, in particular, to antenna supports mounted to poles of substantial height.

Antenna poles or towers have long been used for the transmission, reception and forwarding of radio and television signals. In addition, microwave antennas have come into frequent demand and usage. Such poles generally range in height from 80 to 220 feet and more.

In the parent application identified above, which is explicitly incorporated by reference herein, new and useful improvements in modular poles or towers were disclosed in which shortcomings pertaining to the body sections of prior art towers were addressed. Another shortcoming of many existing antenna towers, including modular towers, concerns the alignment of antenna mounted thereon.

In particular, in order to optimize antenna reception or transmission characteristics such that a very clear signal is received or sent, tuning the antenna, which involves an installer making alignment or positional changes to the antenna, is typically required. These alignment changes may require the installer to manipulate the antenna in a variety of directions or ways. To facilitate the task of tuning an antenna, it is desirable that the device which supports the antenna also be freely adjustable to provide options as to how realignment of the antenna can occur. In addition, if separate antennas are disposed at the top of an antenna tower, it is desirable to be able to independently adjust or align the antennas without adversely affecting alignment of other previously tuned antennas.

SUMMARY OF THE INVENTION

In one form thereof, the present invention provides an antenna support for use with an antenna and for installation on a structure. The antenna support includes a framework mountable to the structure, and an antenna mounting support means coupled to the framework. The antenna mounting support means mounts an antenna to be adjustable in a plurality of directions relative to the framework such that the mounted antenna is tunable by adjustments in the plurality of directions.

In another form thereof, the present invention provides an antenna support for use with a plurality of antennas and for installation on a structure. The antenna support includes a framework mountable to the structure and an antenna mounting support means coupled to the framework. The antenna mounting support means mounts the plurality of antennas to be separately adjustable in a plurality of directions relative to the framework such that each of the plurality of mounted antenna is tunable by adjustments in the plurality of directions.

In still another form thereof, the present invention provides an antenna support for installation on a tower including a ring shaped flange with a plurality of fastener receiving bores therein. The antenna support includes a framework having a mounting collar structured to engage the tower and which includes a plurality of arcuate slots concentrically arranged and alignable with the fastener receiving bores.

The antenna support also includes means for mounting an antenna coupled to the framework. The antenna support and thereby the antenna may be adjustably rotated within the confines of the arcuate slots when fasteners inserted therethrough are in a loosened condition. After the support is rotated, the fasteners may be tightened to secure the antenna support in a desired position.

An advantage of the antenna support of the present invention is that antennas mounted thereon are readily adjustable in a variety of directions to facilitate tuning. Another advantage of the antenna support of the present invention is that a multitude of separate antennas mounted thereon can be independently adjusted. Other advantages of the present invention will become apparent from the following description.

BRIEF DESCRIPTION OF THE DRAWINGS

FIG. 8 is an enlarged view of the encircled region referenced as 8 in FIG. 2, which shows the attachment of the walkway platform to the truss of the support framework.

FIG. 9 is a side view of FIG. 8, with the tubular member of the framework truss shown not angled for purposes of illustration, and with a mounting bracket shown on a support component pipe in a vertical orientation and in a tilted orientation in shadow.

Corresponding reference characters indicate corresponding parts throughout the several figures.

DESCRIPTION OF THE PREFERRED EMBODIMENTS

The preferred embodiments illustrated are not intended to be exhaustive or to limit the invention to the precise forms disclosed. The embodiments were chosen and described in order to best explain the principles of the invention and its application and practical use to thereby enable others skilled in the art to best utilize the invention.

Figures 1, 1A:
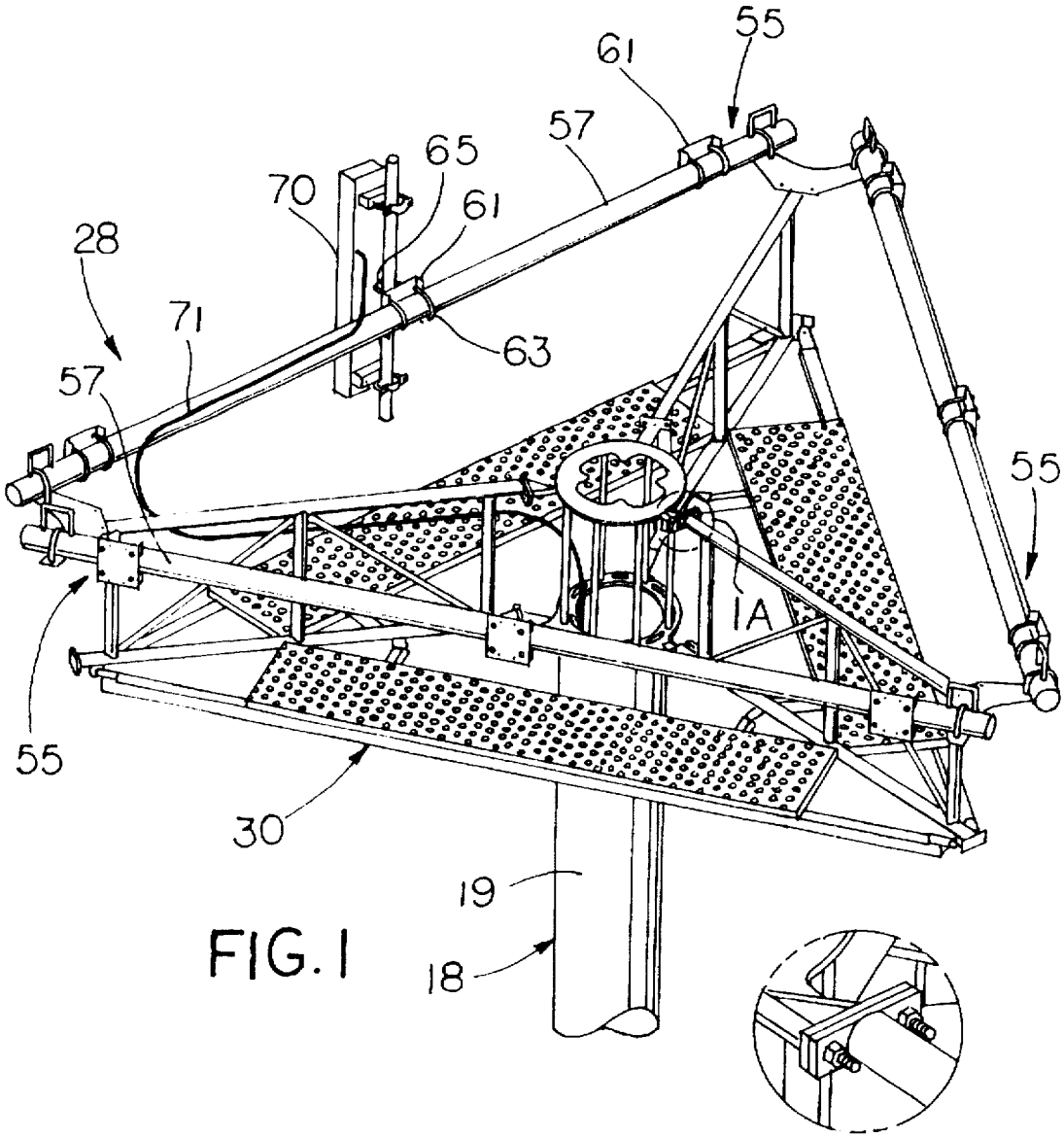
FIG. 1 is a perspective view of one embodiment of the antenna support of the present invention operationally disposed on a tower and with two antennas mounted thereon.
FIG. 1A is an enlarged view of that portion of FIG. 1 enclosed within broken line circle 1A.

Referring now to FIG. 1, there is shown a perspective view of an antenna support of the present invention, generally designated 28, in the form of an assembly installed on the top of an uppermost body section 19 of modular tower 18. Antenna support 28 essentially includes a base skeleton or framework 30, which is stationary after its initial attachment to tower 18, and three independently adjustable antenna mounting support assemblies 55, connected to framework 30, upon which the antennas are adjustably disposed.

Figure 2:
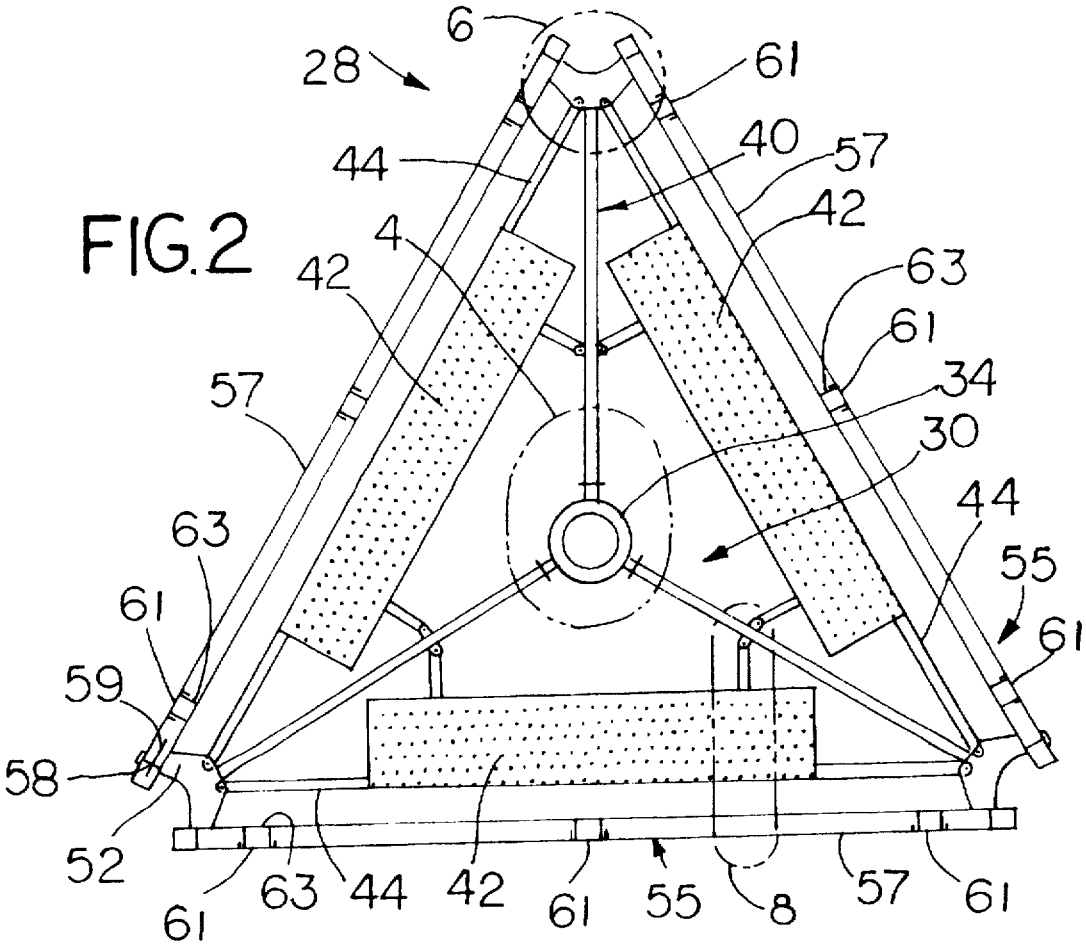
FIG. 2 is a top view of the antenna support of FIG. 1 with a differently configured mounting collar assembly.
Figure 4:
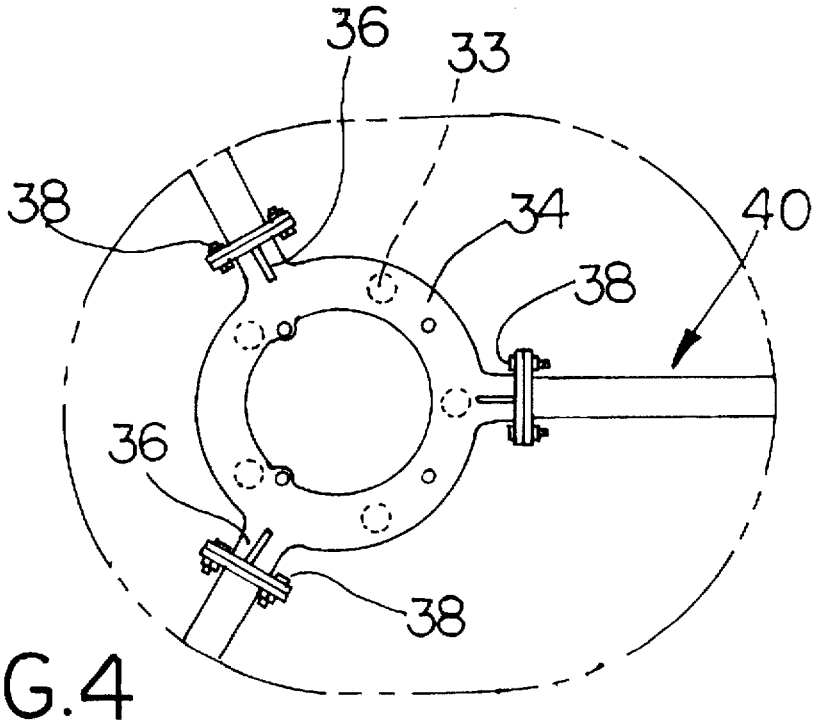
FIG. 4 is an enlarged view of the encircled region referenced as 4 in FIG. 2, which shows the central portion of the antenna support framework which when properly installed is in axial alignment with the tower.
Figure 5:
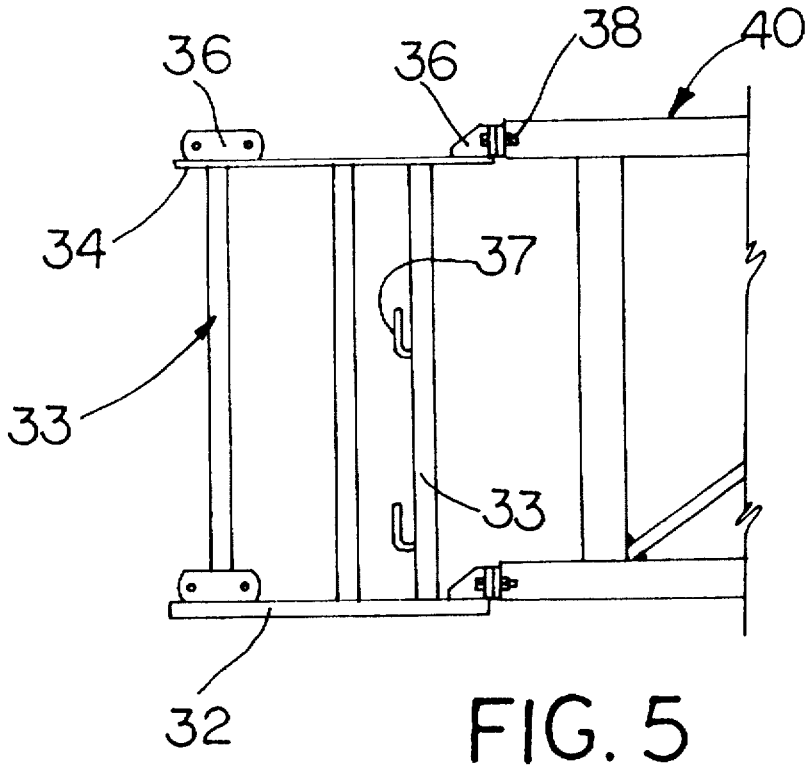
FIG. 5 is a side view of a portion of the present invention illustrated in FIG. 4.
Figure 7:
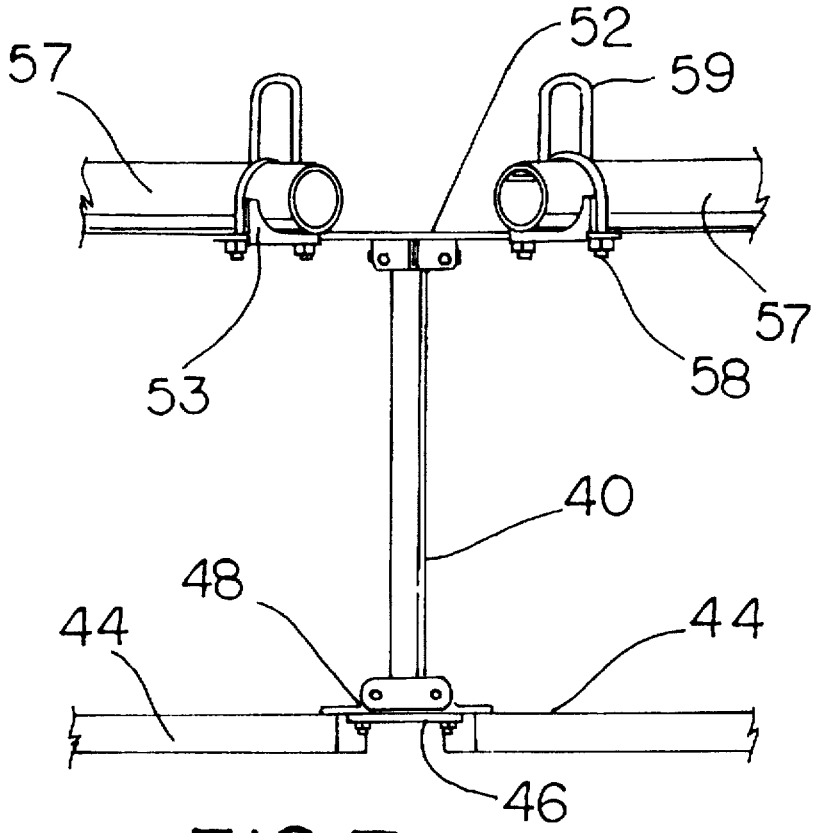
FIG. 7 is a side view of the portion of the present invention illustrated in FIG. 6.
Figure 10:
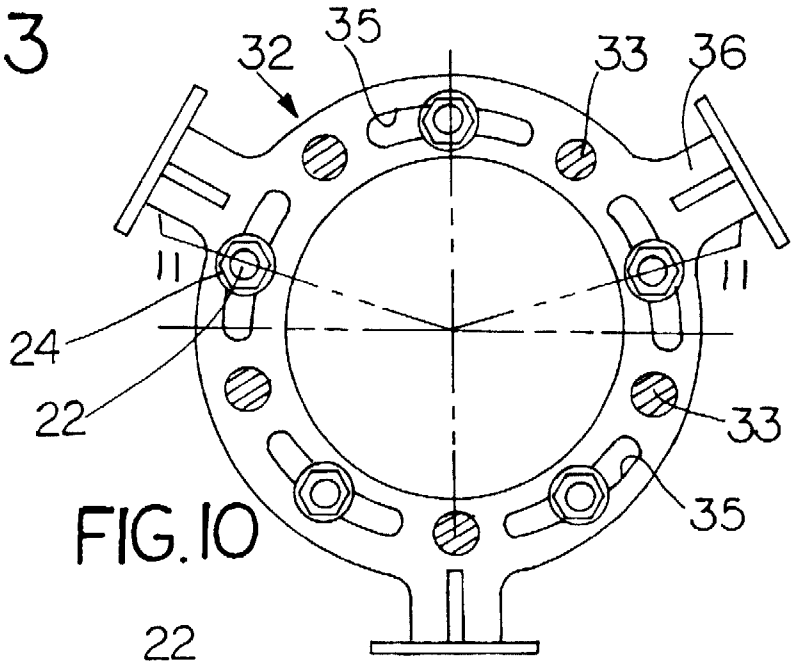
FIG. 10 is a cross-sectional view of the framework central mounting collar as taken along line 10—10 of FIG. 3.

The antenna support shown in FIG. 2 is similar to antenna support 28 of FIG. 1 in all respects except for minor differences in the mounting collar assembly configuration, and is therefore correspondingly referenced. Referring to FIGS. 2–5, framework 30 includes a central mounting collar 32 which is connected to an upper collar 34, disposed directly above central mounting collar 32, by tubular bars 33 extending therebetween. A warning beacon can be attached to and extend upwardly from upper collar 34. Central mounting collar 32 includes a plurality of concentric arcuate slots 35 (see FIG. 10) formed therein which are used to mount antenna support 28 to the top of tower 18 in a rotationally adjustable manner described more fully below. Hooks 37, aligned radially inwardly, are preferably provided on all tubular bars 33 and are used in tying down or otherwise maintaining the wires 71 which extend to the mounted antennas 70 (See FIG. 1). As best shown in FIGS. 4 and 5, collars 32, 34 include flanged radial extensions 36 disposed at 120° intervals. Flanged radial extensions 36 are secured to the flanged inward ends of three identically sized and shaped trusses 40 by bolts or similar type fasteners 38. Trusses 40, which radially extend from extensions 36, are formed of interconnected tubular members in a manner known in the art to achieve a rigid but lightweight framework 30. A boomerang shaped bracket 52, preferably having pipe supporting flanges 53 connected thereto as shown in FIG. 7, is preferably bolted or otherwise rigidly connected to the upper horizontal tube of each truss 40 at its flanged outward end.

Figure 6:
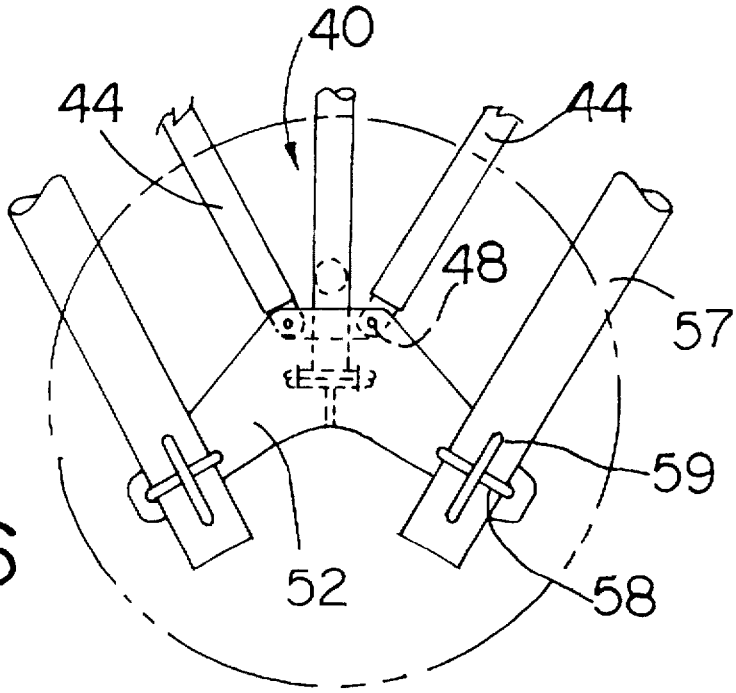
FIG. 6 is an enlarged view of the encircled region referenced as 6 in FIG. 2, which shows the attachment of the support framework to the antenna mounting support assembly.

Framework 30 also includes three walkway platforms 42 which may be utilized by installers of antennas 70. Each walkway platform 42 is supported by a longitudinally extending horizontal beam 44 attached to the platform underside. As best shown in FIGS. 6 and 7, the opposite ends of each beam 44 are interconnected by way of intermediate attachment plates 46, which are preferably welded to the underside of the lower tubes of their respective trusses 40, and associated bolt fasteners 48. This linkage of beams 44 increases the rigidity of framework 30. Each walkway platform 42 is further linked to adjacent trusses 40 by separate angled bars 45 which are bolted to attachment plates 50 that are welded to the underside of the lower tubes of their respective trusses 40 as shown in FIGS. 8 and 9.

Figure 3:
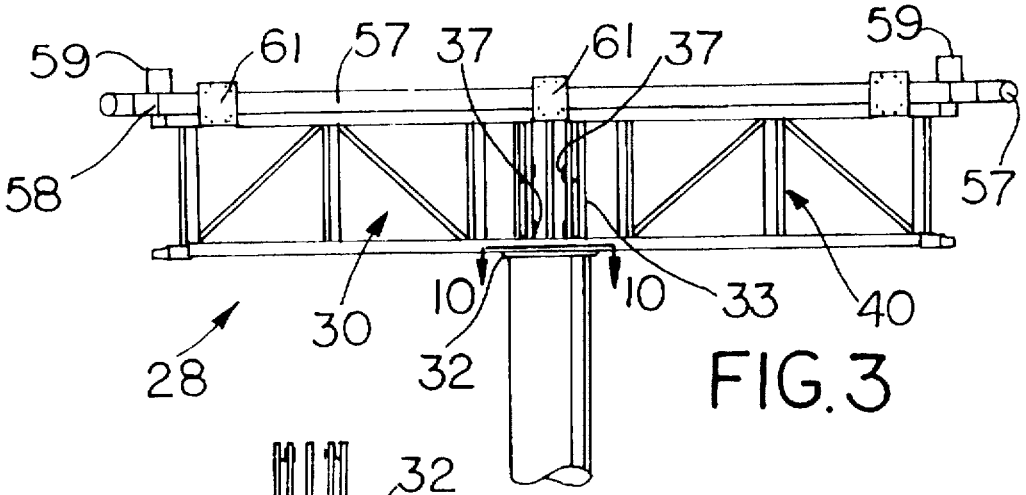
FIG. 3 is a side view of the antenna support of FIG. 2.

As shown in FIGS. 1–3, each antenna mounting support assembly 55 preferably includes an independently movable antenna support component 57 which is formed of an elongated pipe which is round in cross section. Proximate each of its ends, each pipe 57 is connected to boomerang shaped framework bracket 52 by way of U-shaped bolt 58, which extends through apertures in bracket 52 and is tightened thereto with washers, lock washers, and hex nuts in a conventional manner. Pipe or component 57 further includes U-shaped stop members 59 at either end through which the respective bolts 58 are inserted during assembly.

Still referring to FIGS. 1–3, three antenna mounting brackets 61 are connected to each antenna support pipe 57. While three brackets 61 are shown, more or fewer brackets can be employed on each pipe 57 depending on the number of antennas desired to be independently mounted. Each mounting bracket 61 is connected to pipe 57 with a pair of U-shaped bolts 63 similar in concept to bolts 58. The support or mounting shaft of antenna 70 (see FIG. 1) can in turn be connected to mounting bracket 61 by additional fastening linkages 65 or U-shaped bolts extending beyond the outward surfaces of brackets 61.

Figure 11:
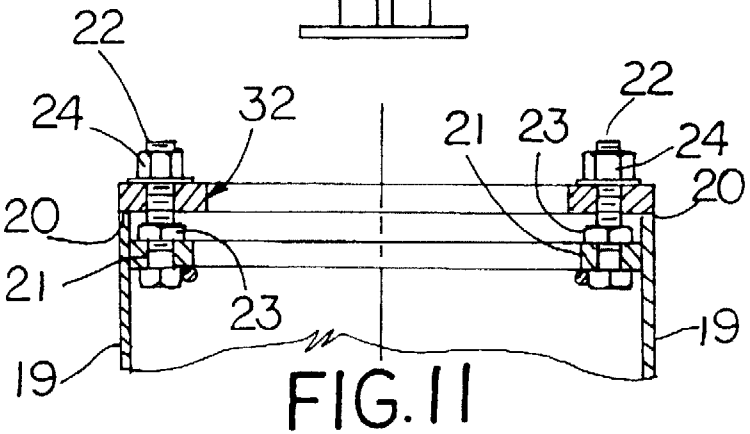
FIG. 11 is a side cross-sectional view, taken along line 11—11 in FIG. 10, of an adjustable connection of the central mounting collar to a preferred tower embodiment.

The structure of the preferred embodiment of antenna support 28 will be further explained by a description of its operational assembly. The entire antenna support 28 is first installed to its support structure, such as the top of tower 18. More particularly, antenna support 28 is first aligned and then lowered such that mounting collar 32 contacts a support surface of tower 18. As shown in FIG. 11, for the preferred construction of tower 18 the support surface is the upper annular lip 20 of uppermost body section 19. Ring shaped flange 21 is welded to the interior surface of tower body section 19 at a location sufficiently proximate annular lip 20 such that bolts 22, maintained in ring shaped flange 21 by nuts 23, project upwardly beyond the height of lip 20 a sufficient distance to allow nuts 24 to secure mounting collar 32 to annular lip 20. Bolts 22, which are preferably installed through bores in flange 21 before uppermost body section 19 is incorporated into tower 18, are disposed in alignment and in a one-to-one correspondence with mounting collar arcuate slots 35. When antenna support 28 is initially lowered onto annular lip 20, lock nuts 24 are applied but not tightly secured. The entire antenna support 28 may then be rotated about the axis of the tower into its exact and most effective position, at which time lock nuts 24 are fully turned for securement.

Figure 12:
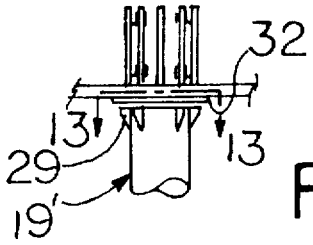
FIG. 12 is a diagrammatic side view of the central mounting collar connected to an alternate construction of the tower end.
Figure 13:
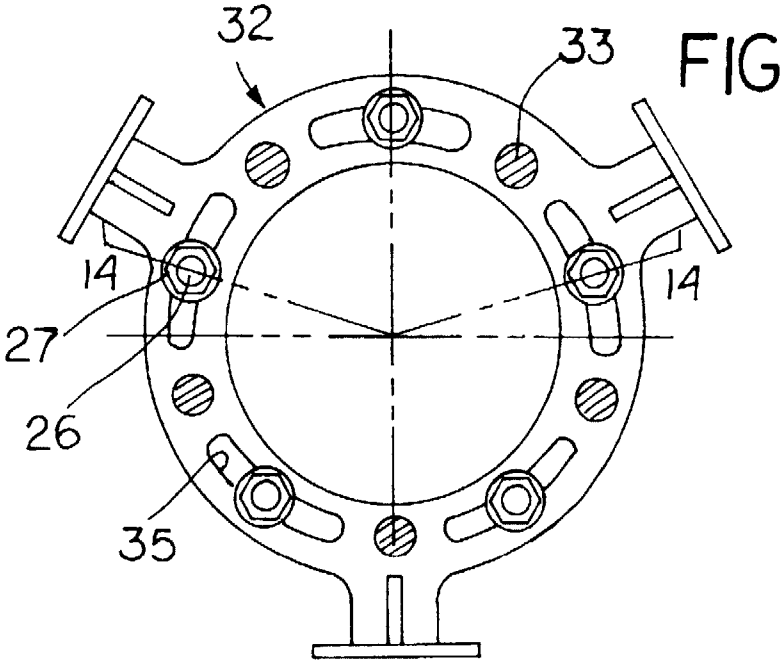
FIG. 13 is a cross-sectional view of the framework central mounting collar as taken along line 13—13 of FIG. 12.
Figure 14:
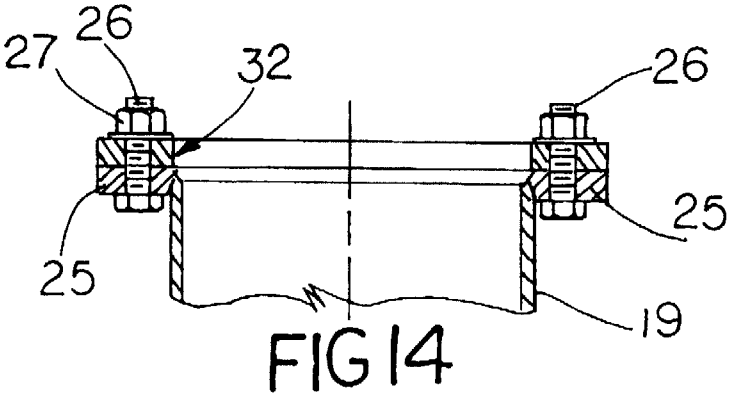
FIG. 14 is a side cross-sectional view, taken along line 14—14 in FIG. 13, of an adjustable connection of the central mounting collar to the alternate tower embodiment.

An alternate construction of tower 18 which provides for the adjustable mounting of antenna support 28 is explained in conjunction with FIGS. 12–14, which disclose side and cross-sectional views. The tower support surface contacting antenna mounting collar 32 is a ring shaped flange 25 welded to the exterior of body section 19' and braced with gussets 29. For a given diameter mounting collar 32, body section 19' of FIG. 14 would be of a lesser diameter than body section 19 of FIG. 11. After bolts 26 are passed through bores in flange 25 and arcuate slots 35 in mounting collar 32, lock nuts 27 are applied but not tightly secured. As described above, the entire antenna support 28 may then be rotationally adjusted and lock nuts 27 finally secured.

As illustrated in FIG. 1, an antenna 70 can be inserted and secured to mounting bracket 61. A number of individual antennas can be attached to separate mounting brackets 61, or a larger single antenna structure could be coupled with multiple brackets 61. Wires 71 for each of the antennas 70 are routed upward from the tower base through the core of the tower 18, through the central opening of mounting collar 32 and fastened to hooks 37, and outward toward the antennas 70. Wires 71 may also be fastened to trusses 40. While the open construction of framework 30, and in particular the openings in collars 32, 34, allow the elements such as rain and snow to enter the core of tower 18, the elements are not accumulated therein as the anchor bolts which connect the lowest cylindrical body section of tower 18 with the concrete base create a gap therebetween through which moisture passes.

Tuning of the individual antennas 70 can be achieved by a variety of movements of the antenna mounting support assembly by an installer safely perched on walkway platforms 42. For instance, after the U-shaped bolts 58 located at opposite ends of antenna support component 57 are loosened, an installer can slide antenna support component or pipe 57 horizontally in its longitudinal direction and relative to framework brackets 52. To prevent pipe 57 from being fully removed from its connecting bolts, the range of this longitudinal motion is limited by U-shaped stop members 59 which abut bolts 58. While bolts 58 are loosened, antenna support pipe 57 can also be rotated about its longitudinal axis. These longitudinal and rotational movements of pipe 57 cause all of the mounting brackets 61 securely attached thereto to experience the same motion. Consequently, adjustments to pipe 57 are advantageous in situations either when only one mounting bracket 61 has an antenna 70 mounted thereto, or when more than one mounting bracket 61 has an antenna 70 attached thereto and it is desirable to move all of these antennas in the same manner.

Tuning of antennas 70 can also be achieved by fixedly securing pipe 57 to framework 30 and manipulating the separate mounting brackets 61. For example, by loosening its respective U-shaped bolts 63, mounting bracket 61 can be axially moved, i.e. slid along the length of pipe 57, as well as be rotated around the longitudinal axis of pipe 57 to a position shown in shadow in FIG. 9. Such movements of mounting bracket 61 cause its corresponding mounted antenna 70 to move laterally and to be tilted respectively. Moreover, by loosening fastening linkages 65 which attach the mounting shaft of antenna 70 to mounting bracket 61, antenna 70 can be rotated about a generally vertical central axis as well as adjustably moved up and down. Thus, an installer can first align and tune antenna 70, and then, by tightening the various loosened bolts, secure antenna 70 in this determined optimal orientation.

Figure 15:
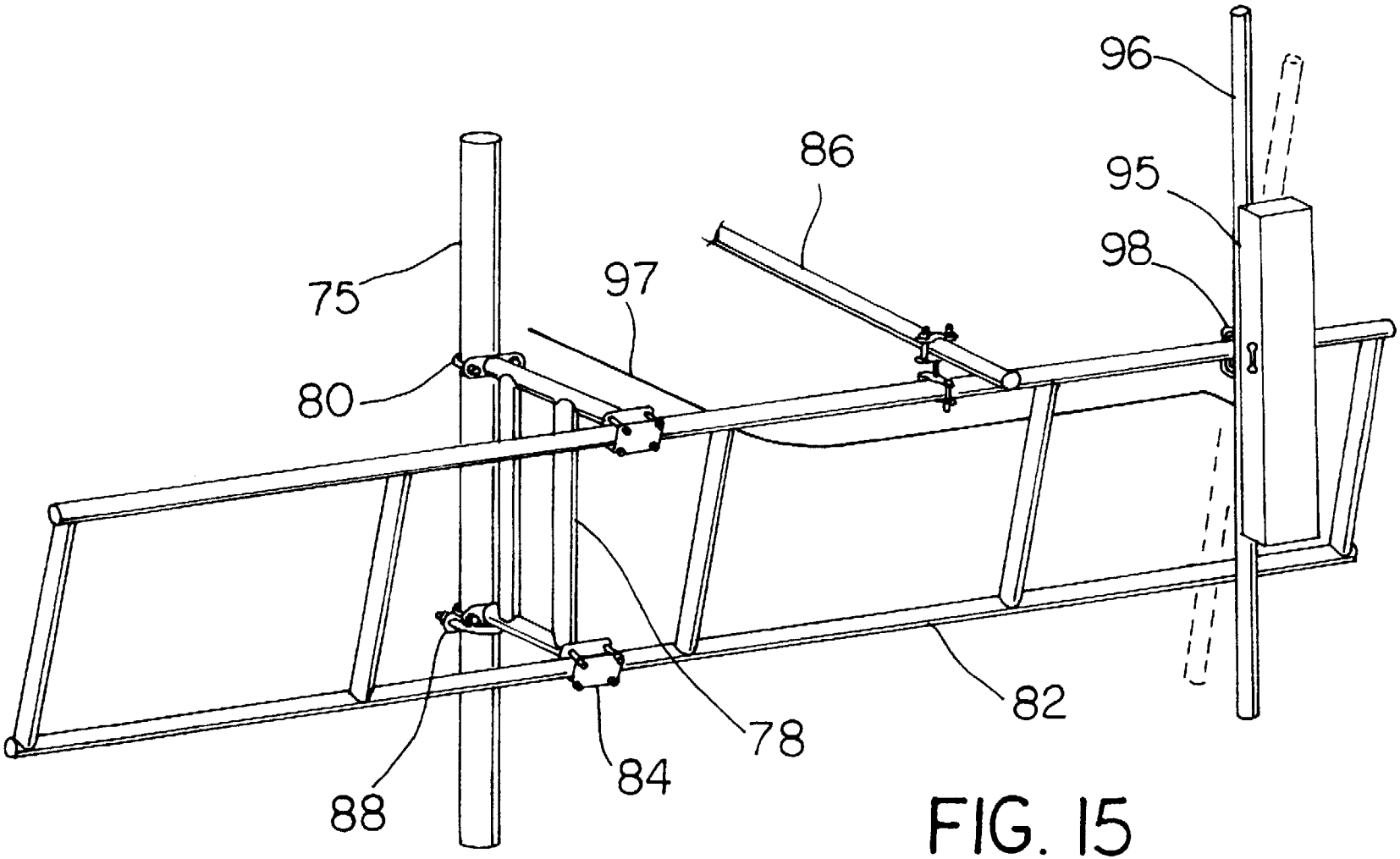
FIG. 15 is a perspective view of an alternate embodiment of the antenna support of the present invention.

The multi-direction adjustability of the antenna support of the present invention may also find beneficial application with other support structures such as towers different from the shown modular tower. An alternate embodiment of an antenna support of the present invention particularly suited for use with a tower having multiple legs is shown in FIG. 15. This T-frame antenna support includes a support framework having a vertically disposed pipemount bracket 75 which can be mounted to a tower leg or crossarm, as well as possibly to an upstanding post or building. The framework also includes angled strut arm 78, which is mounted to pipemount bracket 75 with U-shaped bolts 80 and to antenna mounting support arm bracket 82 with clamps 84. Consequently, by loosening bolts 80, support arm bracket 82 can be rotated about pipemount 75 to adjust the mounted antenna. U-bolt assembly 88 on pipemount bracket 75 is used as a shear ring under strut arm 78. An additional framework bracing pipe 86 may be connected to a horizontal leg of support arm bracket 82 and to, for example, another tower leg not shown, to impart additional stability to the antenna support.

An antenna 95 with antenna wire 97 on mounting shaft 96 is attached to the upper leg of support arm bracket 82 with suitable clamp type fasteners. Due to the vertical angling of support arm bracket 82 achieved by angled strut arm 78, as shown in shadow antenna 95 can be rotated or tilted around mounting arm bracket 82 to a proper orientation.

While this invention has been described as having preferred designs, the present invention may be further modified within the spirit and scope of this disclosure and the appended claims. This application is therefore intended to cover any variations, uses, or adaptations of the invention using its general principles. Further, this application is intended to cover such departures from the present disclosure as come within known or customary practice in the art to which this invention pertains.

What is claimed is:

1. In combination:

at least one antenna; and an antenna support for installation on a structure, the antenna support comprising:

a framework mountable to the structure;

an antenna mounting support means, coupled to said framework, for mounting the antenna to be adjustable in a plurality of directions relative to said framework, whereby the mounted antenna is tunable by adjustments in said plurality of directions wherein said antenna mounting support means comprises:

at least one elongated antenna support component having a longitudinal axis in the direction of the elongation;

means for connecting the antenna support component to said framework such that the antenna support component is longitudinally adjustably relative to said framework, and at least one means for mounting the antenna connected to the antenna support component, whereby the antenna is tunable by longitudinal adjustments of the antenna support component.

2. The combination of claim 1 wherein said means for connecting the antenna support component to said framework further provides for rotational adjustments of the antenna support component about said longitudinal axis, whereby the antenna is further tunable by rotational adjustments of the antenna support component about said longitudinal axis.

3. The combination of claim 2 wherein said at least one means for mounting the antenna further comprises an antenna mounting bracket and a means for coupling said mounting bracket to the antenna support component to be rotatably adjustable about the longitudinal axis thereof, whereby the antenna is further tunable by rotational adjustments of said antenna mounting bracket about said longitudinal axis.

4. The combination of claim 3 wherein said mounting bracket coupling means further provides for said mounting bracket to be longitudinally adjustable along said antenna support component, whereby the antenna is further tunable by longitudinal adjustments of said antenna mounting bracket along said antenna support component.

5. The combination of claim 4 wherein said at least one means for mounting the antenna comprises a plurality of mounting brackets for mounting separate antennas.

6. The combination of claim 2 wherein said longitudinal axis is disposed substantially horizontally when the combination is operationally installed on the structure.

7. In combination:

at least one antenna;

an antenna support for installation on a structure, the combination comprising:

a framework mountable to the structure an antenna mounting support means, coupled to said framework, for mounting the antenna to be adjustable in a plurality of directions relative to said framework, whereby the mounted antenna is tunable by adjustments in said plurality of directions, wherein said antenna mounting support means comprises:

at least one elongated combination component comprising a longitudinal axis in the direction of the elongation, wherein said longitudinal axis is disposed substantially horizontally when the antenna support is operationally installed on the structure;

means for connecting the antenna support component to said framework such that the antenna support component is rotationally adjustable about said longitudinal axis, and at least one means for mounting the antenna connected to the antenna support component, whereby the antenna is tunable by rotational adjustments of the antenna support component about said longitudinal axis.

8. The combination of claim 7 wherein said antenna mounting means comprises an antenna mounting bracket and a means for coupling said mounting bracket to the antenna support component to be rotatably adjustable about the longitudinal axis thereof, whereby the antenna is tunable by rotational adjustments of said antenna mounting bracket about said longitudinal axis.

9. The combination of claim 8 wherein said mounting bracket coupling means further provides for said mounting bracket to be longitudinally adjustable along said antenna support component, whereby the antenna is further tunable by longitudinal adjustments of said antenna mounting bracket along said antenna support component.

10. The combination of claim 8 wherein the antenna includes a shaft defining a central axis, and wherein said at least one antenna mounting means further comprises a means for coupling the antenna shaft to said mounting bracket such that the antenna shaft is rotatably adjustable about the central axis, whereby the antenna is further tunable by rotational adjustments of the antenna shaft about the central axis.

11. In combination:

a tower including a ring shaped flange with a plurality of fastener receiving bores therein: and an antenna support for installation on the tower, said antenna support comprising:

a framework comprising a mounting collar structured to engage the tower, said mounting collar including a plurality of arcuate slots concentrically arranged and alignable with the fastener receiving bores, and means for mounting an antenna coupled to said framework, whereby the antenna support and thereby the antenna may be adjustably rotated within the confines of the arcuate slots when fasteners inserted therethrough are in a loosened condition, after which the fasteners may be tightened to secure the combination in a desired position.

12. The combination of claim 11 wherein the tower includes a columnar body with an annular hip at the body upper boundary, wherein the ring shaped flange is disposed internally to the columnar body, and wherein said mounting collar when installed contacts the columnar body annular lip.

13. The combination of claim 11 wherein the tower includes a columnar body, wherein the ring shaped flange is disposed externally to the columnar body, and wherein said mounting collar when installed contacts the ring shaped flange.

14. The combination of claim 7 wherein said at least one antenna comprises a plurality of antennas.

15. The combination of claim 14 wherein said at least one means for mounting the antenna comprises a plurality of mounting brackets and coupling means for separately mounting said plurality of antennas to be rotatably adjustable about said longitudinal axis.

* * * * *